United States Patent [19]

Weatherston

[11] 4,437,818

[45] Mar. 20, 1984

[54] OIL-FREE ROTARY COMPRESSOR

[76] Inventor: Roger C. Weatherston, 58 Bridle Path, Williamsville, N.Y. 14221

[21] Appl. No.: 326,766

[22] Filed: Dec. 2, 1981

[51] Int. Cl.[3] ..... F01C 1/08; F04C 18/00

[52] U.S. Cl. ..... 418/9; 418/206

[58] Field of Search ..... 418/9, 191, 205, 206

[56] References Cited

U.S. PATENT DOCUMENTS

| | | | |
|---|---|---|---|
| 1,029,157 | 6/1912 | Ullman | 418/206 |
| 4,033,708 | 7/1977 | Weatherston | 418/206 |
| 4,076,469 | 2/1978 | Weatherston | 418/206 |

*Primary Examiner*—Leonard E. Smith
*Assistant Examiner*—Jane E. Obee
*Attorney, Agent, or Firm*—Allen J. Jaffe

[57] ABSTRACT

An oil-free rotary compressor having mating impellers rotatably mounted in working chambers; each impeller has at least two profiles; each profile having only one lobe and one well of substantially 180 degrees in arcuate extent. An inlet port communicating directly with all of the profiles and an outlet port in a side plate at the axial extremity of the working chambers. The angular displacement between adjacent profiles is at least 130 degrees and the pitch velocities of each impeller is at least 200 feet per second.

9 Claims, 10 Drawing Figures

OIL-FREE ROTARY COMPRESSOR

BACKGROUND OF THE INVENTION

The present invention relates to rotary compressors and, more particularly, to such compressors of the oil-free type having mating impellers, each of which are of single-lobed construction.

The prior art is replete with varied designs of rotary, oil-free compressors. However, there is yet to be demonstrated in the operation of such compressors one which will attain a high compression efficiency while, at the same time, controlling or reducing the leakage rate. This is especially true in the one hundred pound, industrial air supply market in the popular size ranges of 100 to 200 CFM.

In general, rotary compressors can be classified as either of the screw-type or non-screw type. The screw type compressor while exhibiting good internal compression efficiency is, by nature of its three dimensional construction, a high leakage device. At the 200 CFM level, a successful screw-type compressor has yet to be demonstrated.

In an attempt to reduce leakage losses and simplify construction many two-dimensional compressor designs have been proposed. These designs will be discussed in greater detail hereinbelow. However, suffice to say, that none evidence a combination of compression efficiency and leakage control sufficient to meet the generally accepted standard of 25 horsepower per 100 CFM.

To achieve the one hundred pound output level in the size ranges of 100 to 200 CFM, two separate compression stages must be employed with appropriate intercooling therebetween. Each stage should have a compression ratio of about three. At this compression ratio it is necessary to attain an overall stage compression efficiency of 64 percent to meet accepted performance levels. If a classical Roots compressor, which does not employ internal precompression, were to be used for each stage the resulting compression efficiency would be 64.5 percent, neglecting leakage and tare losses. In as much as the ideal performance level of the Roots compressor is at the threshold of acceptability, it is instructive and convenient to utilize this simple mechanism as a comparator of performance. Some prior designs, which have employed internal precompression features to improve efficiency, have, in fact, resulted in lower efficiencies than would have been obtained with classical Roots compressors; this being due to excessive leakage and overpressure losses. Yet, to achieve the above-mentioned acceptable performance levels, it is essential to employ a high degree of built-in or internal precompression. In an ideal case the gain in compressor efficiency afforded by precompression is 35.5 percentage points. Thus, the importance of precompression is abundantly clear. The goal, however, is to attain precompression in a device that can maintain good leakage control, while at the same time, not giving rise to high overpressures when the gas is discharged.

Certain prior compressors as typified by U.S. Pat. Nos. 2,097,037; 3,535,060; 3,894,822; 3,723,031; 3,790,315; and 4,224,016 result in a pressure build-up phase (precompression) followed by a separate discharge phase whereby for about one-half the time gas is discharged and for about the remainder of the time there is no gas discharge at all. These types of constructions must necessarily be limited to low impeller pitch line velocities of less than 100 feet per second in that such nonsteady discharge pulsations would result in excessive overpressure losses if the impeller velocity is high. Yet, in contrast, it is necessary to have a low ratio of leakage rate to impeller displacement rate. However, to attain such a low ratio high pitch line velocities are necessary. Thus, it would appear that these slow speed, non-steady type compressors are not capable of attaining the desired efficiency levels.

Other prior known two-dimensional compressor designs are typified by U.S. Pat. Nos. 2,266,820 and 4,076,469. These devices markedly reduce the overpressure losses and thereby permit much higher impeller velocities than could be employed in the aforementioned non-steady devices. However, the impellers on these prior devices employ at least three separate profiles, each profile having at least two lobes. These impellers are costly to manufacture, align and assemble. Further, due to the high number of mating transition surfaces on each coacting profile, the leakage losses are high. An additional problem of the last mentioned patents, which is tied to their structure, is that if three or more profiles are required for the pressure build up and delivery process there is a costly axial leakage path between the top of the lobe of the middle profile (profiles) and the compressor housing which allows the high pressure gas in the third or last profile to leak directly back to the inlet pressure gas in the first profile. With a two profile construction this costly leak path does not exist.

SUMMARY OF THE INVENTION

The foregoing problems of the prior art, as well as others not specifically mentioned, are overcome according to the teachings of the present invention which provides an extremely simple, highly efficient, low cost and practical rotary compressor that is capable of achieving the generally accepted performance standards for compressing air or other gases in the range of 100 to 200 CFM.

The rotary compressor of the present invention includes a housing defining two working chambers; mating impellers rotatably mounted in each working chamber; each impeller having at least two profiles with lobes occupying constant axial positions; each profile containing only one lobe and one well, the well volume in one of the profiles in fluid communicating with the well volume in an adjacent profile, inlet port means in fluid communication with all of the profiles; outlet port means which cyclically and alternately coacts with each of the working chambers to deliver a continuous gas discharge therefrom; and the arcuate extent of each profile and the angular displacement between adjacent profiles being such that as a leading well volume in one of the profiles begins to engage with the lobe of its mating profile the trailing well volume in the profile adjacent said one profile is still in communication with the inlet port means whereby the gas in said leading well volume experiences an increase in pressure even though said trailing well volume is still in communication with the inlet port means; which pressure increase is completely retained if the impeller pitch line velocity is sufficiently high.

It should, thus, be apparent that the compressor of the present invention functions to achieve an internal precompression, a constant gas discharge without overpressure losses and a high displacement rate while maintaining leakage losses to a minimum. Moreover, all the profiles are of essentially similar construction (except for transition surfaces) thereby simplifying the manufacture and reducing the costs associated therewith.

BRIEF DESCRIPTION OF THE DRAWINGS

For a fuller understanding of the present invention as well as its characterizing features reference should now be made to the following detailed description thereof taken in conjunction with the accompanying drawings, wherein.

DETAILED DESCRIPTION OF THE PREFERRED EMBODIMENTS

Figure 1:
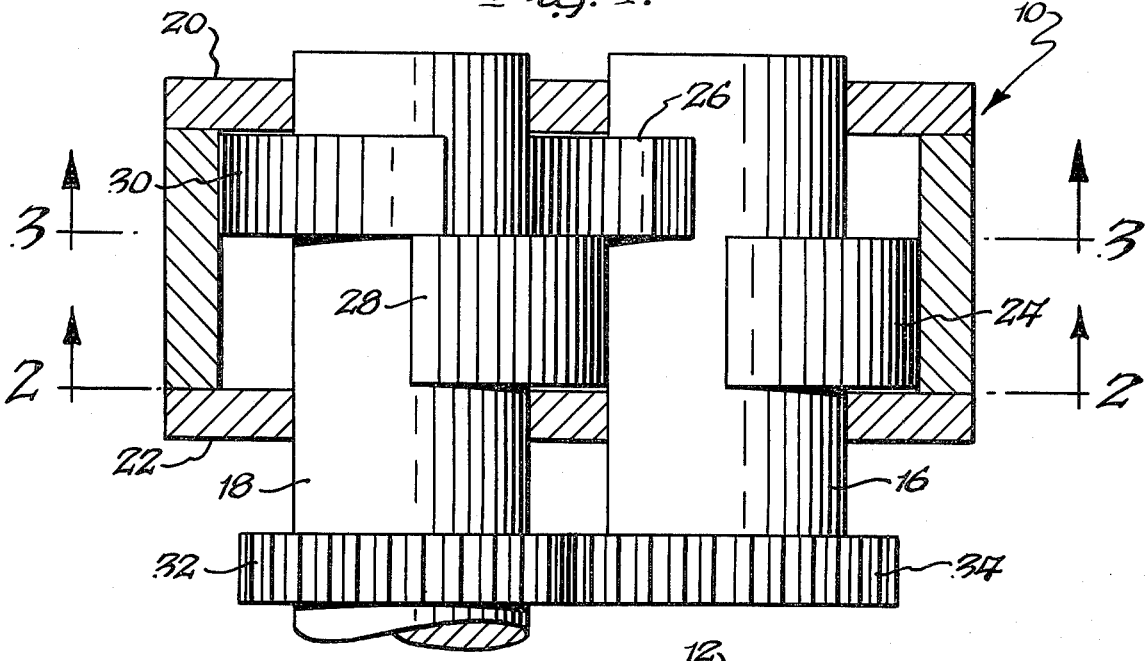
FIG. 1 is a top plan schematic view of the compressor, partially in section, with portions of the housing removed to illustrate the coacting impellers.

Referring now to the drawings, a central housing 10 provides a pair of working chambers 12 and 14 which, respectively, receive a pair of rotatable mating impellers 16 and 18. Central housing 10 may be provided with suitable end plates 20 and 22 at the axial extremities of working chambers 12 and 14, which define therewith a closed casing for the impellers 16 and 18. Impeller 16 is suitably mounted for rotation in the direction of arrow A and is comprised of a pair of adjacent profiles 24, 26 whose lobes occupy constant axial position. Similarly, impeller 18 is suitably mounted for rotation in the direction of arrow B and is comprised of a pair of adjacent profiles 28, 30 whose lobes occupy constant axial positions. Profiles 24 and 28 are identically configured for mating engagement as are profiles 26 and 30. Impellers 16 and 18 may be driven and timed by a pair of gears 32 and 34, as is conventional.

Figure 3:
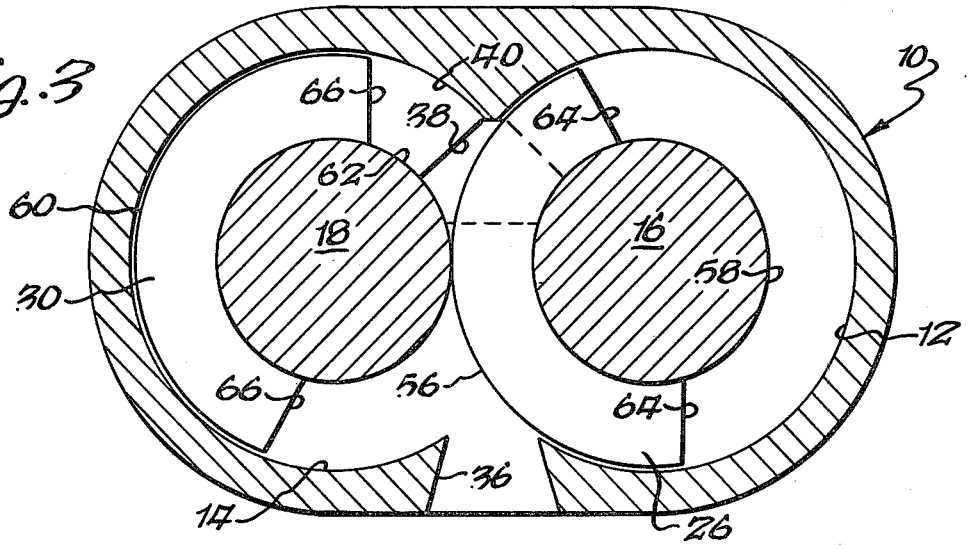
FIG. 3 is a sectional view taken substantially along line 3—3 of FIG. 1.

Inlet port or passage means are provided to communicate simultaneously with each pair of profiles on each impeller. Such means may take the form of a slot 36 which extends along the axial depth of working chambers 12 and 14 between end plates 20 and 22 and intrudes equally into each working chamber. A discharge port or passage means 38 is provided in end plate 20 for equal communication with the profiles 26 and 30 immediately adjacent thereto. As best seen in FIG. 3, discharge port 38 is generally triangular in shape (although other suitable shapes would suffice) and equally overlies each working chamber 12 and 14 below the joining cusp 40 thereof. It should be noted that the tip 42 of cusp 40 is removed in the plane of the profiles 26 and 30 which are adjacent discharge port 38 to thereby provide an initial flow path thereto, as will become apparent hereinbelow.

Profile 24 is comprised of a single lobe 44 and a single well 46 and profile 28 is comprised of a similarly configured single lobe 48 and a single well 50. Each of the lobes 48 and 50 occupy a constant or fixed axial position with respect to its respective impeller, as shown. Lobe 44 and well 46 are joined by substantially concave transition surfaces 52. Similarly, lobe 48 and well 50 are joined by substantially concave transition surfaces 54. Profile 26 is comprised of a single lobe 56 and a single well 58 and profile 30 is comprised of a similarly configured single lobe 60 and a single well 62. Lobe 56 and well 58 are joined by tapered planar transition surfaces 64. Similarly, lobe 60 and well 62 are joined by tapered planar transition surfaces 66. Lobes 44,48,56 and 60 are substantially sealingly engaged with the interior walls of their respective working chambers.

Profiles 24 and 26 are angularly displaced from each other such that the trailing region of well 46 overlaps and communicates with the leading region of well 58. A similar angular relationship exists between the wells 50 and 60 of profiles 28 and 30, respectively. As used herein the term "trailing region" means the region or well volume that is last to pass under cusp 40 whereas the term "leading region" means the region or well volume that is first to pass under cusp 40.

Prior to a discussion of the operation of the compressor thus far described, the structural relationship between the lobe and well of each profile will be given, as this is important in understanding the manner in which the compressor of the present invention can achieve a relatively high compression ratio, a high displacement rate and relatively low leakage losses. More specifically, the lobe and well of each profile are each substantially 180 degrees in arcuate extent. The well center of profile 26 and profile 30 trails the well center of profile 24 and profile 28, respectively, by about 165 degrees (as shown) to thereby provide a 15 degree overlap or open sector between the leading edge of each lobe 44,48 and the trailing edge of each lobe 56,60. This open sector allows fluid communication between the wells of each profile in each working chamber. The trailing edge of each lobe 44,48 and the leading edge of each lobe 56,60 overlap to prevent well to well communication in these regions.

If only a compression ratio of about two were required then the well centers of profiles 26,30 need only trail the well centers of profiles 24,28 by only about 110 degrees. However, for a compression ratio of three it is necessary that the lag between well centers be at least 130 degrees; this requirement being met by the 165 degrees illustrated. This angular relationship or offset between well centers actually determines the degree of internal precompression that can be realized before the trailing edge of lobes 56,60 first expose their corresponding wells to outlet port 38. Moreover, for compression ratios in excess of two, profiles 24 and 28 should be of a greater width than profiles 26 and 30 as is illustrated.

Figure 2:
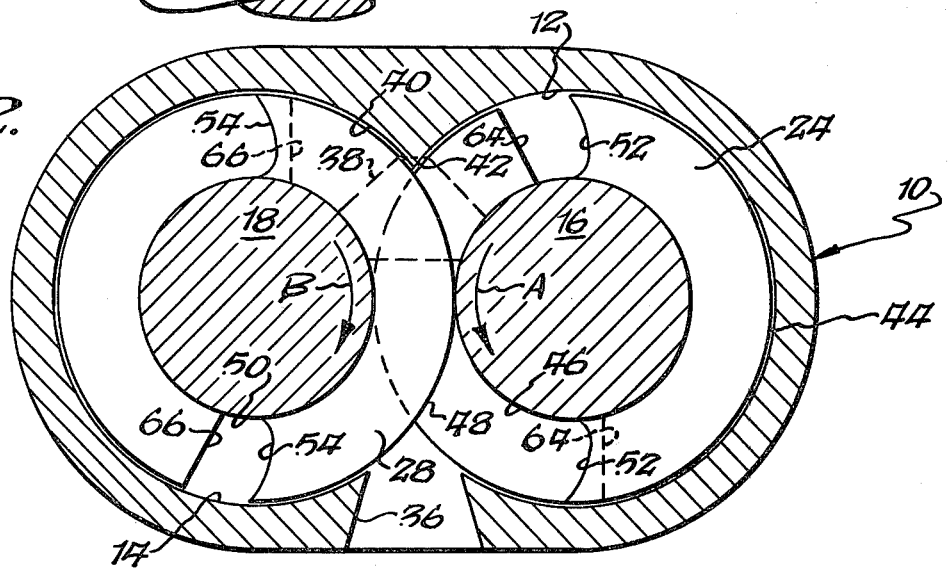
FIG. 2 is a sectional view taken substantially along line 2—2 of FIG. 1.

FIGS. 4–9 are similar to FIG. 2 and should now be referred to as an aid to understanding the operation of the compressor according to the present invention.

Figure 4:
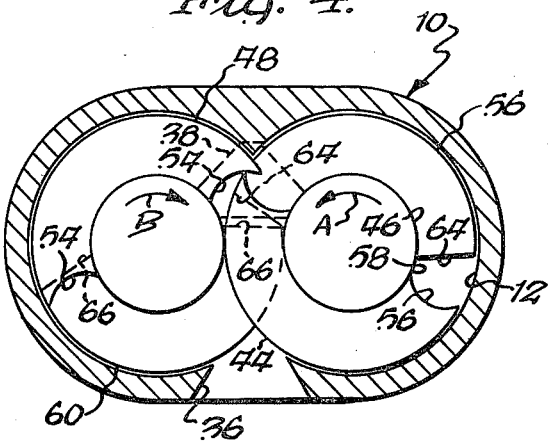
FIGS. 4–9 are views similar to FIG. 3 but illustrating the impellers to their various operating positions.
Figure 7:
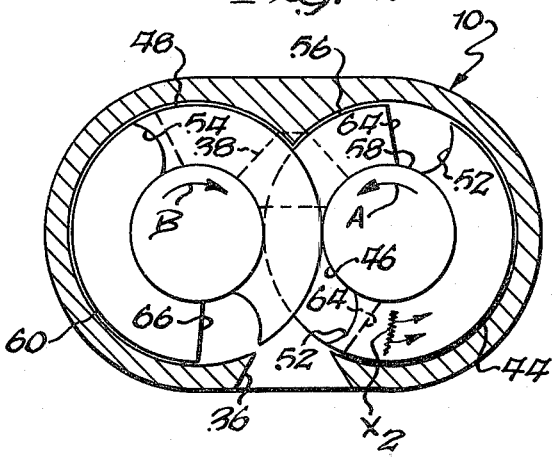
Figure 5:
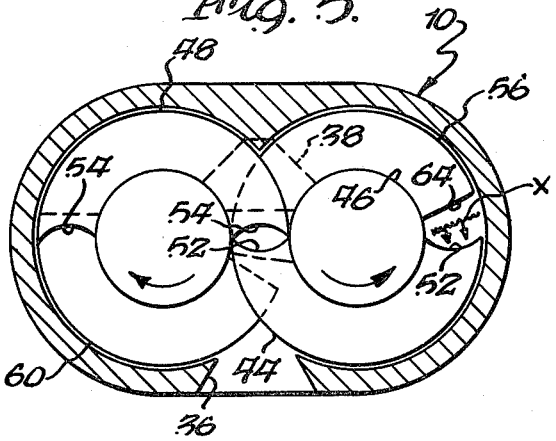
Figure 8:
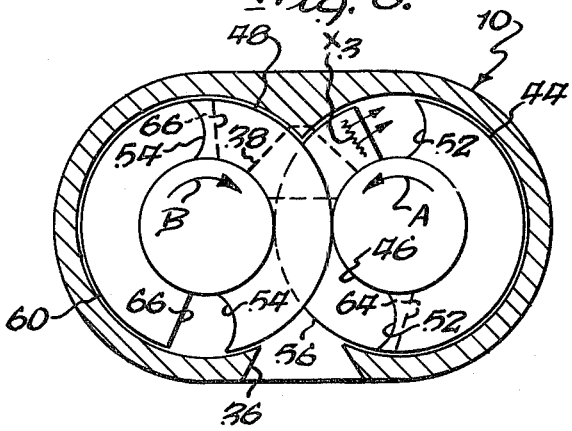

In the position of the impellers shown in FIG. 4 the compression process is about to begin in working chamber 12 as the leading edge of lobe 48 makes its way into the well 46 and the outlet port 38 in blocked from communication with wells 46 and 58 by the action of the side face of lobe 56. In this position well 58 is in communication with inlet port 36 and contains gas at inlet pressure. Inlet pressure is also in well 46 via the communication afforded between the two wells by the overlapping open volume between the leading edge of lobe 44 and the trailing edge of lobe 56. From this position onward it is quite apparent that lobe 48 will continue to displace the gas in well 46 and eventually the lobe 60 will make its way into well 58 to thereby displace the gas in the well 58 to the discharge 38.

As previously indicated, it is an objective of the compressor according to the present invention to provide a high pitch line velocity to attain a low ratio of leakage to displacement. For purposes of illustration (FIGS. 4–9) a pitch line velocity of 250 feet per second and a unitary inlet pressure of 1 is assumed. Thus when the gas in well 46 is brought to rest against the abutment provided by lobe 48 a shock wave is generated in well 46 which travels at a Mach No. of 1.13 through well 58 in a clockwise direction toward inlet 36. The pressure behind this shock wave or front increases by about a factor of 1.33, which front is depicted at X in FIG. 5. It is significant to note that although the pressure in well 46 behind the shock front X is about 1.33 times the inlet pressure, the pressure in wells 46 and 58 ahead of the front is still at inlet pressure and in communication with inlet port 36 and gas is still being ingested thereto. If the impeller pitch line velocity were low, say less than 100 feet per second, the pressure level behind front would be low enough such that if the same spilled back to the inlet, the compressor performance would not be materially affected. However, in the present case, the shock wave strength with an impeller velocity of 250 feet per second is sufficiently large that the gas therebehind should not be allowed to dump back into the inlet. As used herein the term "pitch line velocity" is the linear velocity of a point on the pitch circle of each impeller, as is well known.

Figure 6:
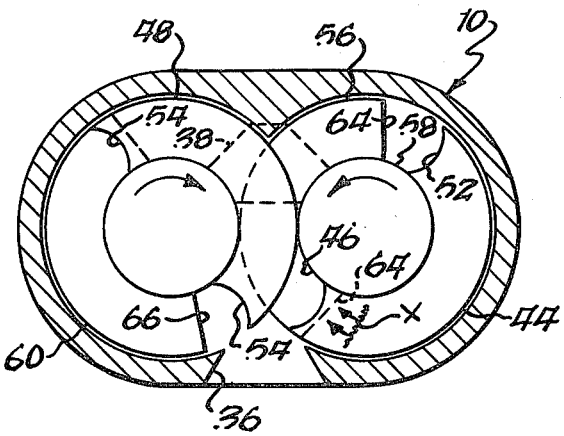
Figure 9:
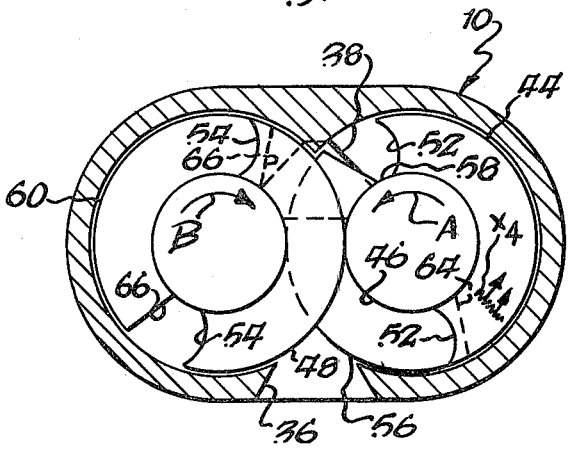

FIG. 6 illustrates the relationship between the impeller profiles which prevents the high pressure gas behind the shock front X from being dumped back into the inlet 36. Thus, as shown in FIG. 6, the leading edge of lobe 56 is about to block communication between the inlet 36 and the well 58 as the shock front arrives thereat. Thus, the pressure behind this front is still maintained at substantially 1.33 times the inlet pressure. In fact, it has been found that, for air, the impeller pitch line velocities must be at least substantially 200 feet per second if the first compression shock wave front is to be contained or "captured". The velocity would be different depending upon the speed of sound of the working fluid. It is clearly within the purview of the present invention to utilize fluids other than air. Further, it should be noted that the well 58 remains in communication with inlet 36 until substantially 45 degrees of impeller rotation at the beginning of the compression process. In the position shown in FIG. 7, as the first shock wave front is reflected off the leading edge of lobe 56 a second shock wave front is created at $X_2$ and the pressure of the gas behind this front is about 1.73 times the inlet pressure. As shown front $X_2$ travels through wells 58 and 46 in a counterclockwise direction towards outlet 38 and comes into abutting contact with lobe 48, whereat a third shock front is reflected clockwise towards the inlet 36. This third shock front is depicted at $X_3$ in FIG. 8 and increases the pressure level of the gas therebehind to a factor of about 2.23 times the inlet pressure. The final wave front is generated when the front $X_3$ is reflected off the leading edge of lobe 56, as depicted at $X_4$ in FIG. 9, and travels counterclockwise. back towards the outlet 38. The gas pressure behind this front $X_4$ is brought up to the final internal precompresion level of about 3 times that of inlet pressure. Very shortly after the position shown in FIG. 9 shock front $X_4$ will arrive at the mating position and the entire volume of well 58 will be up to final pressure. At this time, the trailing edge of lobe 56 will expose the well 58 to the discharge port 38 and the gas therein will be discharged therethrough to a point of use as a consequence of the mating action of lobe 60 into well 58. The action previously described will then be repeated for the left-hand impeller for the second half of the compression cycle. Thus, no further description thereof is deemed necessary.

Figure 10:
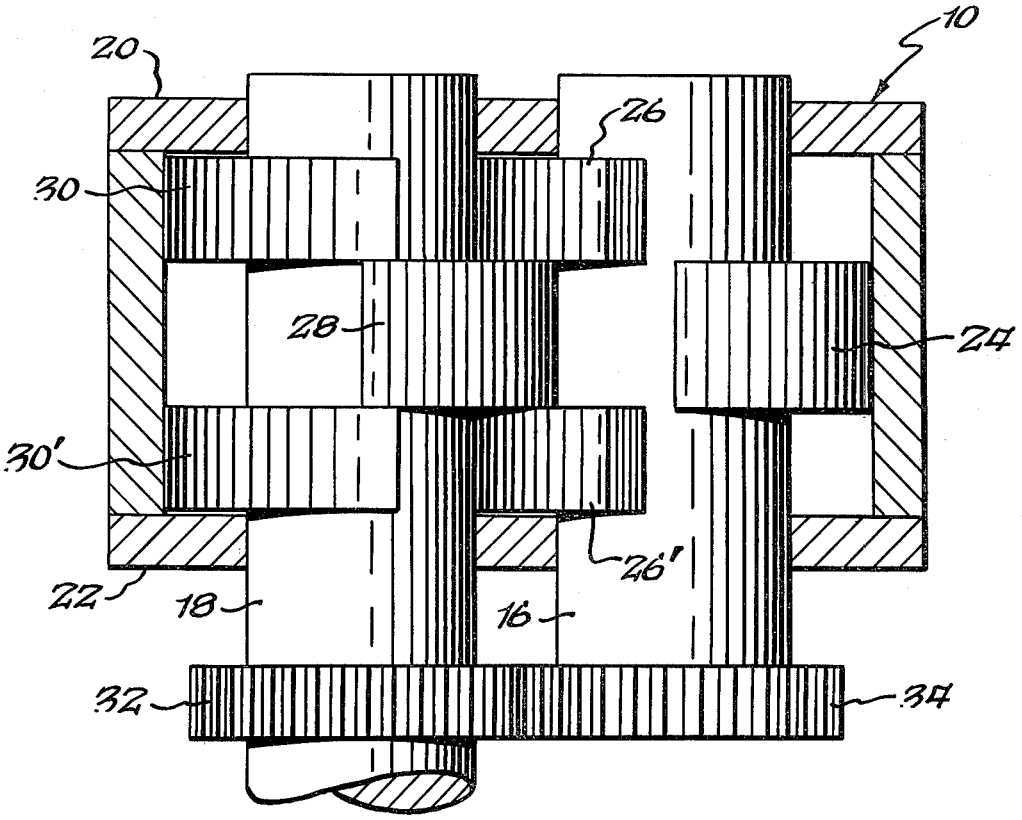
FIG. 10 is a view similar to FIG. 1 but illustrating the inclusion of a third impeller profile in each working chamber to provide a symmetrical and balanced structure.

Although the foregoing description related to impellers each having two profiles, in practice it is desirable for mechanical balancing purposes and for substantially thrust-free operation to employ a third profile on each impeller which would be similar in shape and angular alignment to profile 26 on impeller 16 and to profile 30 on impeller 18. This configuration is illustrated in FIG. 10, wherein all reference numerals are similar to those previously used except that those numerals for the third profile are primed. In the device of FIG. 10 it should be apparent that an additional discharge port is required in end plate 22, identical to port 38, for receipt of the gas flowing from profiles 26' and 30', which flow could obviously be combined exteriorly of housing 10.

Although a preferred embodiment of the present invention has been disclosed and described, changes will obviously occur to those skilled in the art.

For example, it would be always possible to modify the leading and trailing edge surfaces of the lobes to alter the flow passages between the profiles as by stepping or slanting the same; and, as such, the lobe cross-sections may locally deviate from being precisely two-dimensional or constant cross-sectional. Such a modification, however, would not substantially effect the basic mode of operation of the present invention. Consequently, as used herein, terms such as "two-dimensional", "constant cross-sectional" and the like should be interpretted as meaning substantially the same in the context of distinquishing over three-dimensional structures such as helical or screw devices.

Further, although the structure of the present invention has been depicted and described as for compressor operation, the same could obviously be employed for expander or motor operation by merely reversing the direction of fluid flow therethrough. In which case, the inlet and outlet passage means would be functionally interchanged.

It is, therefore, intended that the present invention is to be limited only by the scope of the appended claims.

What is claimed is:

1. A rotary compressor comprising:

a housing defining two working chambers;

mating impellers rotatably mounted in each working chamber;

each impeller having at least two profiles;

each profile containing only one lobe and only one well, the well volume in any one profile in fluid communication with the well volume in any other profile of each impeller;

each of said lobes occupying a constant axial position;

inlet port means in direct fluid communication with all of said profiles;

outlet port means for cyclically and alternately coacting with each of said working chambers to deliver a continuous gas discharge; and the arcuate extent of each profile and the angular displacement between adjacent profiles on the same impeller being such that as a leading well volume in one of said profiles begins to engage with the lobe of its mating profile to start precompression of the gas therein at inlet pressure, the trailing well volume in the profile adjacent said first profile is still in communication with said inlet port means, whereby the pressure of the gas in said leading well volume is increased above that in said trailing well volume until the trailing well volume is blocked from communication with said inlet port means.

2. The compressor according to claim 1, wherein:

the pitch line velocity of each of said impellers is sufficiently high to substantially completely contain the gas at increased pressure in said leading well volume even though said trailing well volume is still in communication with said inlet port means.

3. The compressor according to claim 1, wherein:

said communication with said inlet port means persists for at least substantially 45 degrees of impeller rotation before said trailing well volume is blocked from communication therewith.

4. The compressor according to claim 1, wherein:

each of said lobes and said wells are substantially 180 degrees of arcuate extent and each have substantially constant radii.

5. The compressor according to claim 4, wherein:

adjacent profiles on each impeller are angularly displaced with respect to each other substantially at least 130 degrees.

6. The compressor according to claim 5, wherein:

each of said impellers has three profiles, the outer two of which are similar in shape and angular alignment.

7. The compressor according to claim 1, wherein:

said casing includes end surfaces at the axial extremities of each working chamber; and said outlet port means is located in one of said end surfaces in substantially equal overlying relationship with each of said working chambers.

8. The compressor according to claim 1, wherein:

the axial extremities of said working chambers are closed by end surfaces;

each of said impellers having only one center profile and only two outer profiles;

each of said lobes and said wells being substantially 180 degrees in arcuate extent;

the lobes and wells of each of said outer profiles being adjacent to and located on opposite sides of their respective center profiles and each being similar in shape and angular alignment to provide for substantially thrustfree operation; and said outlet port means located in each of said end surfaces adjacent each of said outer profiles and in direct fluid communication therewith.

9. The compressor according to claim 8, wherein:

adjacent profiles on each impeller are angularly displaced with respect to each other substantially at least 130 degrees.

* * * * *